US009224371B1

(12) United States Patent
Wu et al.

(10) Patent No.: US 9,224,371 B1
(45) Date of Patent: Dec. 29, 2015

(54) THREE-IN-ONE DRUM

(71) Applicant: TIANJIN JINBAO MUSICAL INSTRUMENTS CO., LTD., Tianjin (CN)

(72) Inventors: Dingjun Wu, Tianjin (CN); Yongcai Dai, Tianjin (CN); Xiaohu Pei, Tianjin (CN)

(73) Assignee: Tianjin Jinbao Musical Instruments Co., Ltd., Tianjin (CN)

( * ) Notice: Subject to any disclaimer, the term of this patent is extended or adjusted under 35 U.S.C. 154(b) by 0 days.

(21) Appl. No.: 14/702,965

(22) Filed: May 4, 2015

(30) Foreign Application Priority Data

Oct. 29, 2014 (CN) ..... 2014 1 0592474

(51) Int. Cl.
*G10D 13/02* (2006.01)

(52) U.S. Cl.
CPC ..... *G10D 13/026* (2013.01)

(58) Field of Classification Search
CPC ... G10D 13/02; G10D 13/026; G10D 13/021; G10D 13/00; G10D 13/027; G10D 13/028; G10G 5/00; G10H 1/32; G10H 2230/275; H04R 1/08; H04R 1/1033; H04R 1/2834; H04R 2201/023
USPC ..... 84/411 R, 421
See application file for complete search history.

(56) References Cited

U.S. PATENT DOCUMENTS 241,195 A * 5/1881 Cubley ..... 84/421

* cited by examiner

*Primary Examiner* — Kimberly Lockett
(74) *Attorney, Agent, or Firm* — Rosenberg, Klein & Lee

(57) ABSTRACT

A three-in-one drum includes a drum chamber, a drum skin and pressing rings. A beating tray is vertically and adjustably disposed in the drum chamber and covered with a cushion. The bottom of the beating tray has a microphone vibrator connected to a loudspeaker box. When the adjusting rod is rotated clockwise, the beating tray rises and the cushion is close to the drum skin. The drum skin does not ground when being beaten, this is the mute drum function. An beating trigger connected with an electronic sound source sends electronic signal to perform the electric drum function. The microphone vibrator amplifies the audio frequency signal to perform the audio amplification function. When the adjusting rod is rotated counter clockwise, the beating tray is lowered and the cushion is located away from the drum skin which sounds when being beaten to perform the raw sound drum function.

3 Claims, 3 Drawing Sheets

THREE-IN-ONE DRUM

BACKGROUND OF THE INVENTION

1. Fields of the Invention

The present invention relates to a music instrument, in particular a three-in-one drum.

2. Descriptions of Related Art

The conventional drum-type musical instruments have single functions, poor market competitiveness and fail to meet the market demands.

SUMMARY OF THE INVENTION

The technical problem to be solved in the present invention is to provide a multi-functional three-in-one drum.

To solve the above technical problem, the present invention provides a drum chamber, a drum skin and pressing rings and also include a beating tray which is disposed in the drum chamber and is vertically adjusted. The beating tray is covered with a cushion. An annular beating trigger is externally connected with an electronic sound source is disposed between the beating tray and the cushion. The bottom of the beating tray is provided with a microphone vibrator which is externally connected to a loudspeaker box. The cushion is located close to the bottom of the drum skin by the upward adjusting effect of the beating tray.

The drum chamber is symmetrically provided with two inner sliding sleeves. An adjusting rod is rotationally installed between the two inner sliding sleeves. The adjusting rod has a segment of external screw threads on each of the left and right ends. The left and right segments of external screws are opposite to each other and are respectively sleeved with a sliding thread base. One end of the adjusting rod penetrates through the inner sliding sleeves and extends outside to form a square body, which is conveniently operated. The wall of the drum chamber corresponding to the square body is formed with round holes. The bottom of the beating tray is symmetrically provided with two bottom rods. The two bottom rods are respectively connected with corresponding sliding threaded bases through a connecting plate. The two ends of each connecting plate are respectively hinged with the corresponding bottom rod and sliding threaded rod. The height of the beating tray is adjusted by operating the adjusting rod clockwise or counter clockwise.

The two bottom rods at the bottom of the beating tray are fixedly connected to two horizontal tray fixing shafts. The two ends of the two tray fixing shafts are respectively fixedly connected through a sliding base. The two ends of each sliding base are also respectively provided with a downward vertical sliding shaft. The two ends of the two inner sliding sleeves are respectively formed with a run-through guide hole. Each vertical sliding shaft is matched with and inserted into the corresponding guide hole.

The present invention has the following beneficial effects: when the adjusting rod is rotated clockwise, the beating tray rises such that the cushion is located close to the drum skin, and then the drum skin does not ground when being beaten, this is the mute drum function. In connection with the external electronic sound source, the beating trigger sends the electronic signal to perform the electric drum function; in connection with the external loudspeaker box, the microphone vibrator amplifies the audio frequency signal by times, so as to perform the audio power amplification function. When the adjusting rod is rotated counter clockwise, the beating tray lowers such that the cushion is away from the drum skin, the drum skin sounds when beaten, thus performing the raw sound drum function. In addition, the present invention may be used individually and can be equipped on common drum kit.

DETAILED DESCRIPTION OF THE PREFERRED EMBODIMENT

The present invention is described in further detail with reference to the attached drawings and embodiment.

Figure 1:
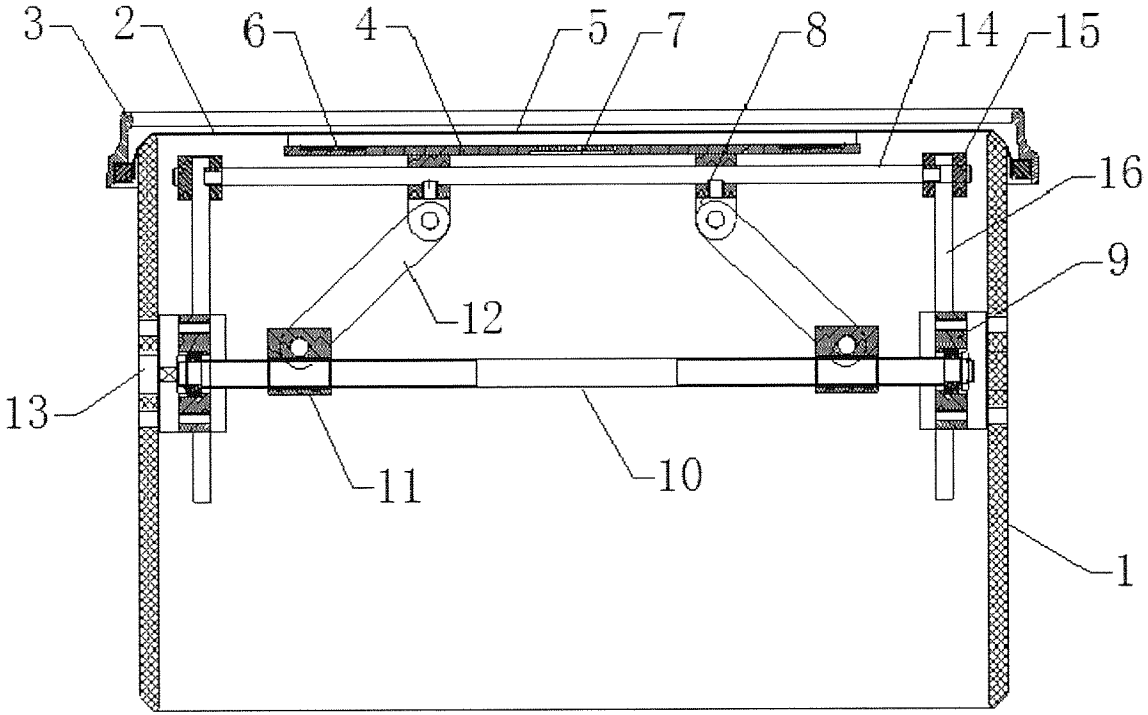
FIG. 1 is a structural view of the three-in-one drum of the present invention when the beating tray rises.
Figure 2:
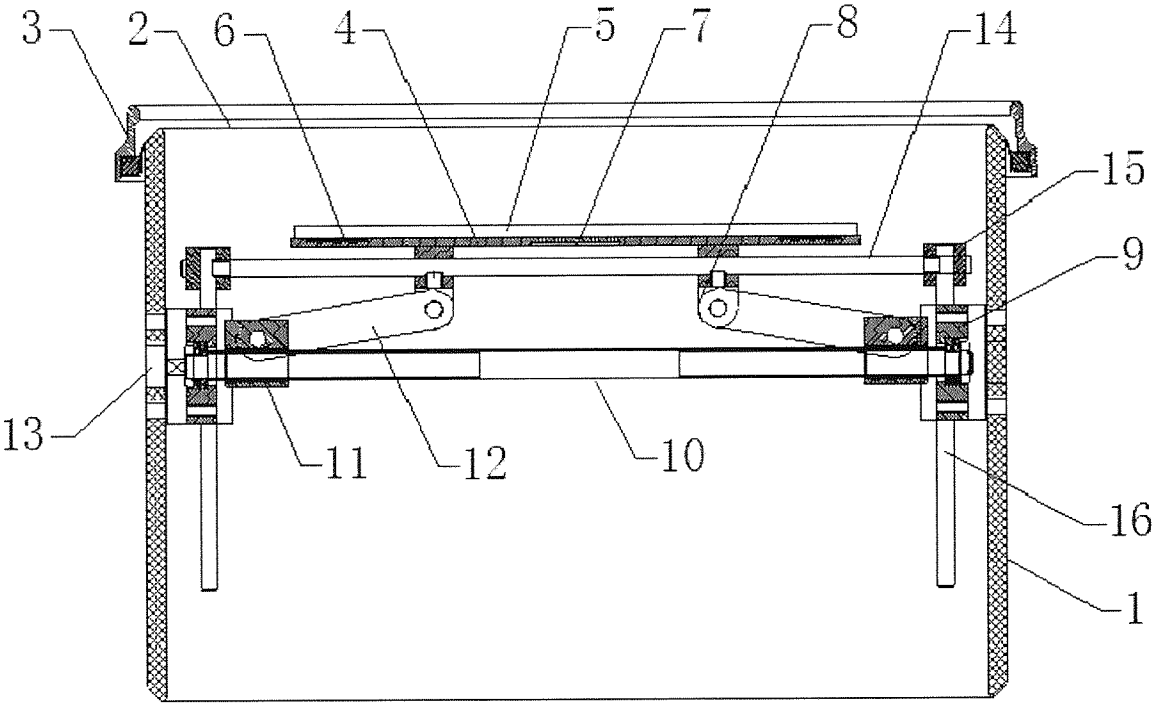
FIG. 2 is a structural view of the three-in-one drum of the present invention when the beating tray descends.
Figure 3:
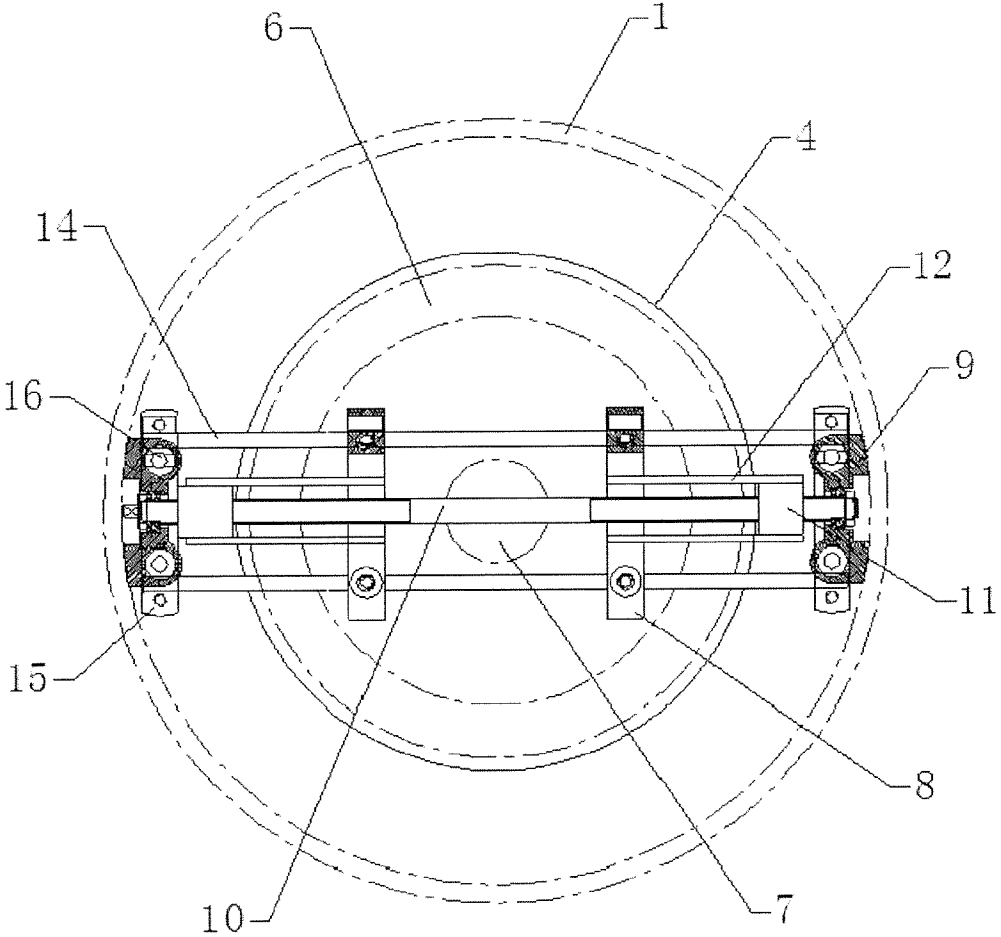
FIG. 3 is a top view of the three-in-one drum of the present invention.

As shown in FIGS. 1-3, the three-in-one drum of the present invention includes a drum chamber 1, drum skin 2 and pressing rings 3 and also includes a beating tray 4 which is disposed in the drum chamber 1 and is vertically adjusted. The beating tray 4 is covered with a cushion 5. An annular beating trigger 6 is externally connected with an electronic sound source and disposed between the beating tray 4 and the cushion 5. The bottom of the beating tray 4 is also provided with a microphone vibrator 7 which is externally connected with a loudspeaker box. The cushion 5 is close to the bottom of the drum skin 2 by the upward adjusting effect of the beating tray 4.

The inner wall of said drum chamber 1 is symmetrically provided with two inner sliding sleeves 9. An adjusting rod 10 is rotationally installed between the two inner sliding sleeves 9. The adjusting rod 10 has a segment of external screw threads on each of the left and right ends. The external screws on the left and right ends are opposite to each other and are respectively sleeved with a sliding thread base 11. One end of the adjusting rod 10 penetrates through the inner sliding sleeves 9 and extends outside to form a square body, which is conveniently operated. The wall of the drum chamber 1 corresponding to the square body is formed with round holes 13. The bottom of the beating tray 4 is symmetrically provided with two bottom rods 8. The two bottom rods 8 are respectively connected with corresponding sliding threaded bases 11 through a connecting plate 12. The two ends of each connecting plate 12 are respectively hinged with the corresponding bottom rod 8 and sliding threaded rod 11. The height of the beating tray 4 can be adjusted by operating the adjusting rod 10 clockwise or counter clockwise. The two bottom rods 8 at the bottom of the beating tray 4 are fixedly connected to two horizontal tray fixing shafts 14. The two ends of the two tray fixing shafts 14 are respectively fixedly connected through a sliding base 15. The two ends of each sliding base 15 are also respectively provided with a downward vertical sliding shaft 16. The two ends of the two inner sliding sleeves 9 are respectively formed with a run-through guide hole. Each vertical sliding shaft 16 is matched with and inserted into the corresponding guide hole.

When the adjusting rod 10 is rotated clockwise, the beating tray 4 rises such that the cushion 5 is close to the drum skin 2, and then the drum skin 2 does not ground when beaten, thus performing the mute drum function. In connection with the external electronic sound source, the beating trigger 6 sends the electronic signal to perform the electric drum function. In connection with the external loudspeaker box, the microphone vibrator 7 amplifies the audio frequency signal by times, performing the audio power amplification function.

When the adjusting rod 10 is rotated counter clockwise, the beating tray 4 lowers such that the cushion 5 is away from the drum skin, the drum skin sounds when being beaten, thus performing the raw sound drum function. In addition, the present invention may be used individually and can be equipped on common drum kit.

In conclusion, the present invention is not limited to above embodiments. Those skilled in this field can put forward other embodiments under the technical guidance of the present invention, of which shall fall within the scope of the present invention.

What is claimed is:

1. A three-in-one drum, comprising a drum chamber (1), a drum skin (2) and pressing rings (3), a beating tray (4) being vertically and adjustably disposed in the drum chamber (1); said beating tray (4) covered with a cushion (5); an annular beating trigger (6) being externally connected with an electronic sound source and disposed between said beating tray (4) and said cushion (5); a bottom of said beating tray (4) provided with a microphone vibrator (7) and being externally connected with a loudspeaker box; said cushion (5) located close to the bottom of the drum skin (2) when the beating tray (4) moves upward.

2. The three-in-one drum according to claim 1, wherein an inner wall of said drum chamber (1) is symmetrically provided with two inner sliding sleeves (9); an adjusting rod (10) is rotationally installed between the two inner sliding sleeves (9); said adjusting rod (10) has a segment of external screw threads on each of left and right ends; the external screws on the left and right ends are opposite to each other and respectively sleeved with a sliding thread base (11); one end of the adjusting rod (10) penetrates through the inner sliding sleeves (9) and extends outside to form a square body which is conveniently operated; the wall of the drum chamber (1) corresponding to said square body is formed with round holes (13); the bottom of said beating tray (4) is symmetrically provided with two bottom rods (8); the two bottom rods (8) are respectively connected with the sliding threaded bases (11) corresponding thereto through a connecting plate (12); two ends of each connecting plate (12) are respectively hinged with the bottom rod (8) and sliding threaded rod (11) corresponding thereto; a height of the beating tray (4) is adjusted by operating the adjusting rod (10) clockwise or counter clockwise.

3. The three-in-one drum according to claim 2 wherein the two bottom rods (8) that are located at the bottom of said beating tray (4) are fixedly connected to two horizontal tray fixing shafts (14); two ends of the two tray fixing shafts (14) are respectively fixedly connected through a sliding base (15); two ends of each sliding base (15) are respectively provided with a downward vertical sliding shaft (16); two ends of the two inner sliding sleeves (9) are respectively formed with a run-through guide hole, each vertical sliding shaft (16) is matched with and inserted into the corresponding guide hole.

* * * * *